US006641447B2

(12) United States Patent
De Vries

(10) Patent No.: US 6,641,447 B2
(45) Date of Patent: Nov. 4, 2003

(54) METHOD OF MANUFACTURING A DISPLAY DEVICE

(75) Inventor: Gosse Charles De Vries, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 484 days.

(21) Appl. No.: 09/729,586

(22) Filed: Dec. 4, 2000

(65) Prior Publication Data

US 2001/0005237 A1 Jun. 28, 2001

(30) Foreign Application Priority Data

Dec. 2, 1999 (EP) ..... 99204077

(51) Int. Cl.[7] ..... H01J 29/28; H01J 9/20
(52) U.S. Cl. ..... 445/23; 445/8
(58) Field of Search ..... 445/23, 8

(56) References Cited

U.S. PATENT DOCUMENTS 4,656,522 A * 4/1987 Piascinski et al. ..... 348/824
5,072,301 A 12/1991 Dziedzic ..... 358/245
5,235,243 A * 8/1993 Tong ..... 313/479

FOREIGN PATENT DOCUMENTS

JP 62160632 A 7/1987 ..... H01J/9/24

* cited by examiner

*Primary Examiner*—Kenneth J. Ramsey
(74) *Attorney, Agent, or Firm*—Aaron Waxler

(57) ABSTRACT

A display device is manufactured having a display with an auxiliary plate. The display window (3) and the auxiliary plate (15) are oriented at an angle of tilt $\alpha_1$, preferably substantially vertically, the volume in between the display window and auxiliary plate is filed up to a selected level height (h) with uncured resin, a seal (17) and an opening (18) being provided at or near the highest point. Thereafter the display window is reoriented to a more horizontal position (smaller angle of tilt $\alpha_2$) the auxiliary plate being positioned on top of the display window inducing a flow v of curable material (16) towards the opening (18), and when the resin has reached the opening the resin near the opening is plugged, where after the angle of tilt is further reduced and the resin is fully cured.

4 Claims, 3 Drawing Sheets

METHOD OF MANUFACTURING A DISPLAY DEVICE

Figure 1:
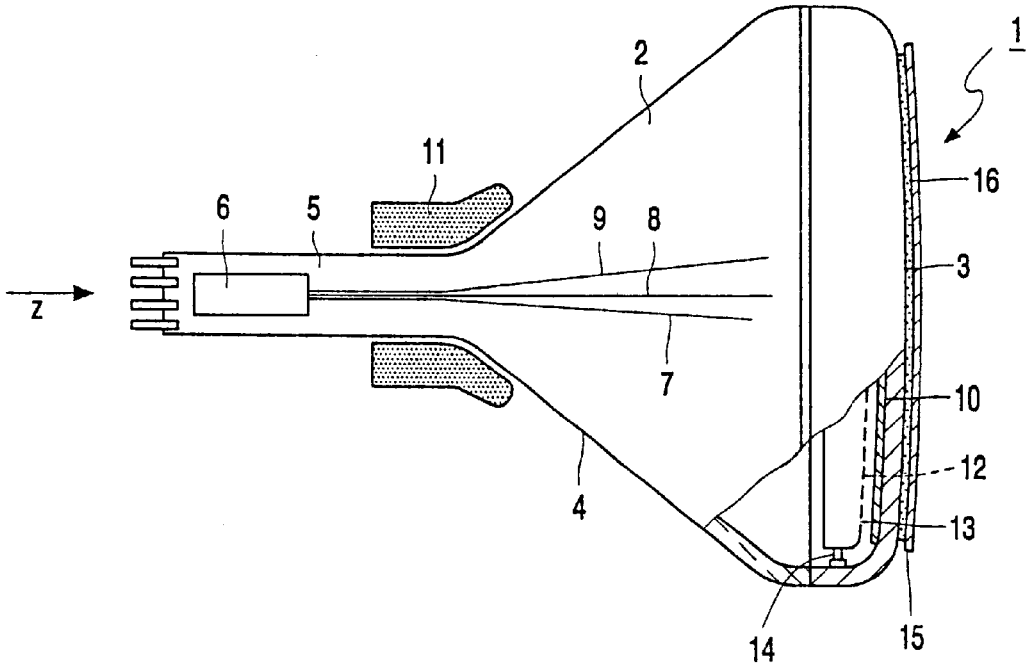

The invention relates to a method for manufacturing a display device having a display window and in front of the display window an auxiliary transparent plate, in which method the display window and the transparent plate are positioned at some distance from each other, the display window and the auxiliary are attached to each other around the edges by a seal, the seal having at least one opening, the volume between the display window and the auxiliary plate being filled with curable material, whereafter the curable material is cured.

Such display devices are known. The display device may comprise for instance a CRT (Cathode Ray Tube) or a PDP (Plasma Display Panel) or an LCD (liquid Crystal Display). The auxiliary plate may be for instance a plate which has an anti-reflective coating or a plate which forms a touch-screen. The auxiliary plate may also be used to enhance the implosion protection. The auxiliary plate is positioned at some distance from the display window (for said purpose spacers may be used). The edges are but for at least one filling opening sealed, thus forming a volume for curable material. Through the opening in the seal curable material is introduced in the volume between the display window and the auxiliary plate. U.S. Pat. No. 5,072,301 describes a method in which display device is so oriented that the display window and the auxiliary plate are oriented vertically, the filling opening being provided at the lowest corner of the gasket formed by the display window, the auxiliary plate and a seal around the edges. Uncured resin is introduced through the filling opening, air being released through an opening at an opposite corner. Near said second opening a sensor is provided for detection of resin. When said sensor detects resin the flow of resin through the filling opening is stopped. The resin is then partially cured, whereafter the flexible seal is removed and the resin is fully cured.

Although the known method does provide for an auxiliary plate to be attached to a display window the position of the auxiliary plate is not well defined and in particular tends to bulge outwards or inwards. Lately more and more emphasis is placed on the amount of flatness of the outer surface of the display device, i.e. the surface at which the viewer is looking. Also the cost of the resin is especially for large size models (more than 20") appreciable.

It is an object of the invention to provide a method in which the position of the auxiliary plate is better definable and/or the amount of resin used may be reduced.

To this end the method is characterized in that the display window and the auxiliary plate are oriented at an first angle of tilt $\alpha_1$ to the horizontal direction, preferably substantially vertically, the volume is partially filed with uncured resin up to a selected level height, the opening being at or near the highest point, thereafter the angle of tilt is reduced to a second angle $\alpha_2$ smaller than the first angle $\alpha_1$, and when the resin has reached the opening the resin near the opening is cured to plug the opening, whereafter the angle of tilt is reduced to a third angle $\alpha_3$, preferably substantially zero, and the rest of the resin is fully cured.

In the known methods the uncured material (here further for simplicity also named 'resin') exerts a force on the auxiliary plate, actually forcing the plate to bulge outwards. This results in an unwanted bulge in the auxiliary plate and furthermore results in more resin being used than is necessary.

In the method in accordance with the invention the volume formed by the display window, the auxiliary plate and the seal is filled with resin. It is not completely filled, but account is taken of the fact that the weight of the resin and the plate forces, in the initial position (i.e. at an angle of tilt $\alpha_1$), the auxiliary plate to bulge outwards. As the orientation of the display window is made more horizontally (i.e. reducing the angle of tilt to a second angle $\alpha_2$ smaller than $\alpha_1$), the weight of the plate and the resin will reduce the bulge, forcing the resin to fill more an more of the volume (actually the volume reduces, while the amount of resin stays the same), until the resin reaches the said opening. This situation is reached at an angle $\alpha_2$ which is larger than zero, i.e. still at an angle, be it a relatively small one (for instance 5–25 degrees). In such circumstances the shape of the auxiliary plate tends to better follow the contour of the outer side of the display window and overall the position of the auxiliary plate vis-à-vis the display window shows less deviations from a constant value. Nevertheless there is slightly (for instance 5–15%) more uncured resin in the volume than needed, i.e. the volume is slightly overfilled. The opening is plugged, preferably by locally curing the resin to prevent resin from flowing out of the said volume. Locally curing the resin, has, in contrast to using plugs, a number of advantages. It is fast, there is no chance of resin being spilled outside the display window and there is no or little chance of air being trapped. Thereafter the angle is further reduced to a third angle of tilt $\alpha_3$, preferably to zero degrees, i.e. to a horizontal positioning of the display window and the auxiliary plate. The rest of the resin is then cured. Curing will reduce the volume of the resin. The overall thickness of the resin layer is reduced, and better controllable thus resulting in a decreased amount of resin used and a better controllable outside contour. The volume is filled at the angle $\alpha_1$ to a selected level. Rather than filing a fixed amount of resin, the volume is filled to a selected level height. This enables to correct for any deviations in the volume.

Preferably the curable material near the opening is cured using an UV light source, while a gas flow of non-reactive gas is provided.

These and further aspects of the invention will be explained in greater detail by way of example and with reference to the accompanying drawings, in which FIG. 1 is display device FIGS. 2A, 2B, 3 and 4 illustrate the method in accordance with the invention.

Figure 5:
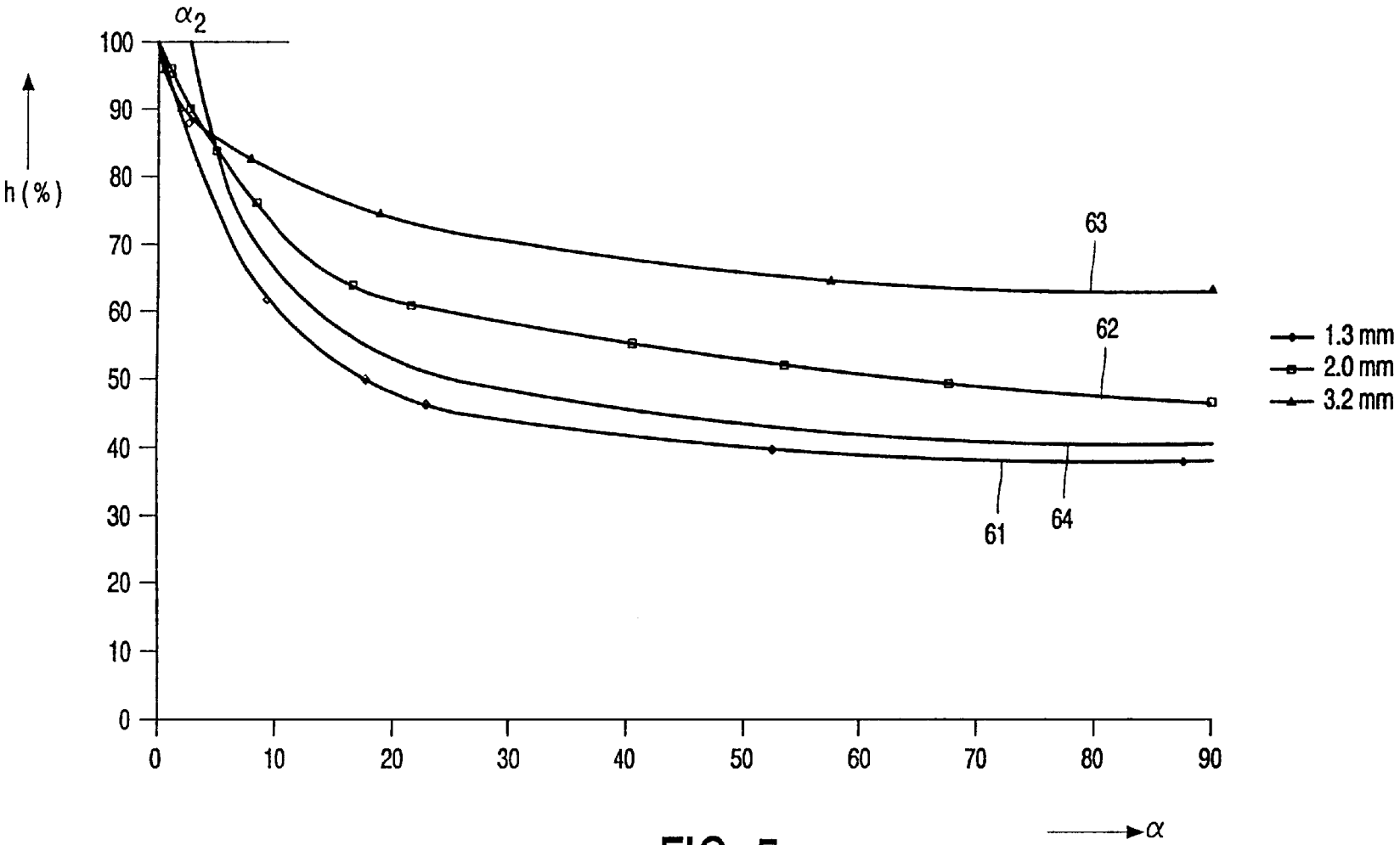

FIG. 5 shows in the form of a graph the height level h as a function of tilt angle $\alpha$.

The figures are not drawn to scale. In general, like reference numerals refer to like parts.

A color display device 1 (FIG. 1) includes an evacuated envelope 2 comprising a display window 3, a cone portion 4 and a neck 5. In said neck 5 there is provided an electron gun 6 for generating three electron beams 7, 8 and 9. A display screen 10 is present on the inside of the display window. Said display screen 10 comprises a phosphor pattern of phosphor elements luminescing in red, green and blue. On their way to the display screen the electron beams 7, 8 and 9 are deflected across the display screen 10 by means of a deflection unit 11 and pass through a shadow mask 12 which is arranged in front of the display window 3 and which comprises a thin plate having apertures 13. The shadow mask is suspended in the display window by means of suspension means 14. The three electron beams converge and pass through the apertures of the shadow mask at a small angle with respect to each other and, consequently, each electron beam impinges on phosphor elements of only one color. In FIG. 1 the axis (z-axis) of the envelope is also indicated. In front of the display window 3 an auxiliary plate 15 is present. The auxiliary plate 15 is attached to the display window 3 via a cured resin layer 16.

The auxiliary plate 15 may be provided for various reasons, such as to reduce reflection or transmission, to provide for a touch-screen or to enhance implosion protection. In this embodiment the display device is or comprises a cathode ray tube (CRT). Although the invention is of particular importance for such devices, due to the usually somewhat curved shape of the outer surface of the display window, within the concept of the present invention the term display device includes other display devices such as PDP and LCD display devices. Ideally the thickness of the resin (cured material) 16 layer is everywhere the same and equal to the thickness of the seal, the ideal or nominal volume then equals the thickness times the area defined by the seal.

Figure 2A:
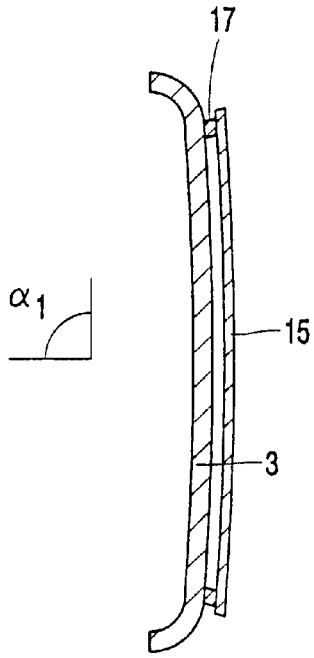
Figure 2B:
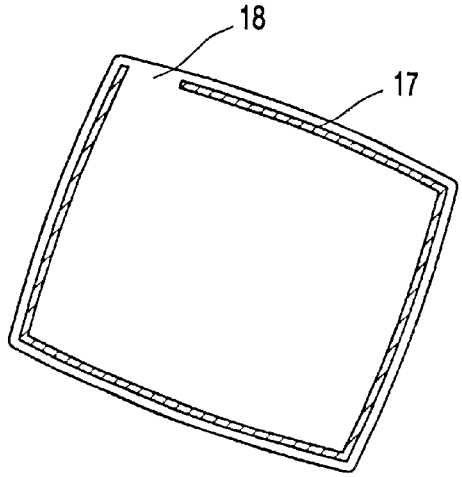
Figure 3:
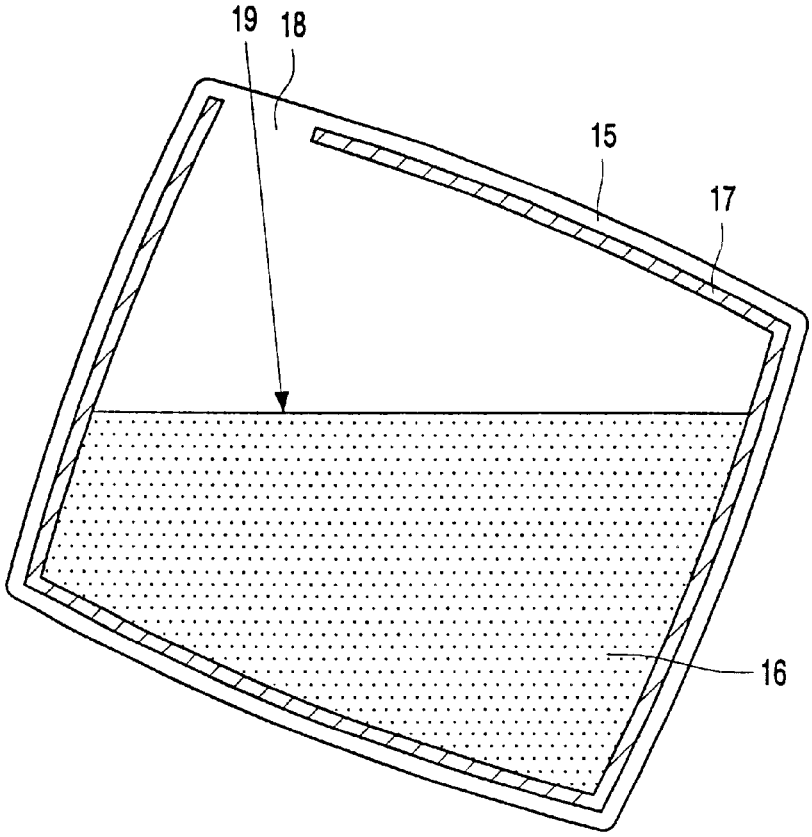
Figure 4:
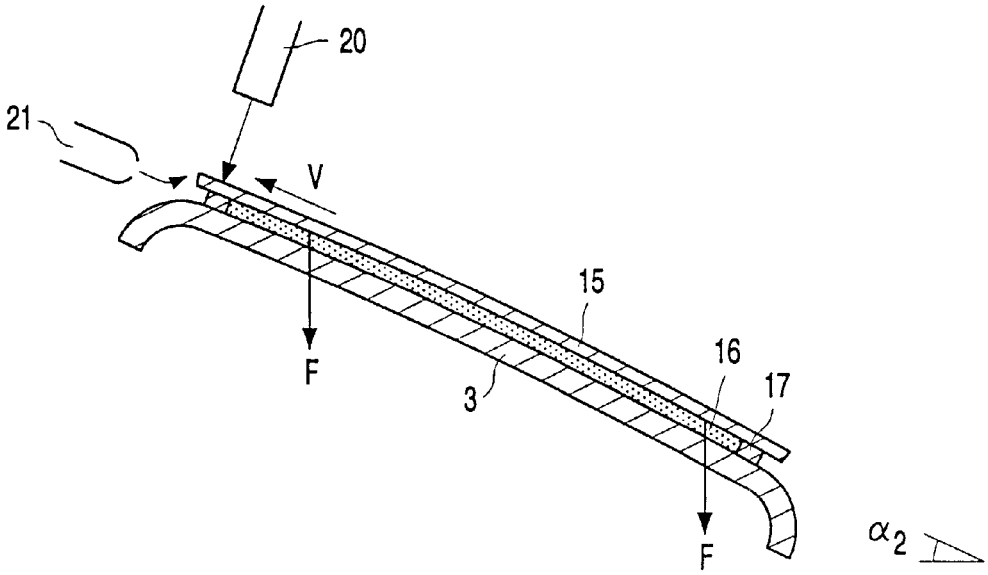

Provision of the auxiliary plate in accordance with the method of the invention is illustrated in FIGS. 2 to 4.

FIGS. 2A and 2B show respectively a front view and a side view. An auxiliary plate 15 is provided on the outer surface of the display window 3. A seal 17 is provided between the auxiliary plate and the display window. This seal may be provided after positioning of the auxiliary plate, or alternatively, either the plate or the display window may be provided with a tape or a band of sealing material after which the auxiliary plate is laid on the display window, in which case the tape or band of sealing material forms the seal. The seal has an opening 18. The device (when the auxiliary plate is provided on an assembled display device) or the display window (when the display window with auxiliary plate is made separately and the display device is later assembled) is oriented in such manner that display window is oriented at an angle $\alpha_1$, preferably substantially vertically, ($\alpha_1$=90°) with the opening 18 at the top. The volume between the auxiliary plate and the display window 3 is filled with curable, but yet uncured material 16 to a selected level height 19. This is preferably done through the opening 18 but could be done through another inlet if said inlet can be closed. The volume is not entirely filed, but (FIG. 3) an upper part near the opening 18 is left unfilled. Because of the vertical orientation of the display window/auxiliary plate assembly, gravitational forces tend to force the auxiliary plate to bulge outwards. The display window/display device/auxiliary plate is then reoriented to a more horizontal orientation (FIG. 4), i.e. at an angle $\alpha_2$. Gravitational forces (depicted in FIG. 4 by arrows F) now flatten the auxiliary plate forcing it to follow more closely the outer contour of the display window and causing the resin to flow towards the opening 18 (schematically indicated in FIG. 4 by the arrow v). To this end the auxiliary plate is positioned above the display window. The volume between the auxiliary plate and the display window diminishes, forcing the resin to flow towards the opening 18. When the resin reaches the opening 18 further flow is inhibited by plugging opening 18 which is preferably done by curing, using a localized application of energy, the resin near and in the opening 18. Such a localized application can for instance be application of a UV light source 20. Preferably this local curing is done while a flow 21 of non-reacting gas (such as $N_2$) is administered. During curing of the resin radical molecules are often formed, which have a tendency to react with any oxygen present. A flow of inert gas prevent such reaction. The resin having been cured near and in the opening, the device/display window is transferred to a curing device to fully cure the resin and positioned at an angle $\alpha_3$, which is less than $\alpha_2$, and preferably zero, meaning that the display window and the auxiliary plate are horizontally oriented, the auxiliary plate lying on top.

If the volume would be filled up completely in the vertical position and then the opening would be plugged, then the auxiliary plate would bulge outwards. If in that position the resin is fully cured, said bulge would be permanently present. In the method in accordance with the invention the display window and the auxiliary plate are oriented at an angle of tilt $\alpha_1$, preferably substantially vertically, the volume is filed up to a selected level height (h) with uncured resin, the opening (18) being at or near the highest point, thereafter the display window is reoriented to a more horizontal position the auxiliary plate being positioned on top of the display window inducing a flow v of curable material (16) towards the filling opening, and when the resin has reached the opening the resin near the opening is plugged, where after the resin is fully cured.

FIG. 5 shows the height level h as a function of tilt angle $\alpha$. The horizontal axis denotes the angle of tilt $\alpha$. The vertical axis denotes the filling height h where h=100% stands for a complete filling of the volume. Line 61 represents filling height h as a function of angle of tilt $\alpha$ for an auxiliary plate having a thickness of 1.3 mm, line 62 for an auxiliary plate having a thickness of 2.0 mm and line 63 for an auxiliary plate having a thickness of 3.2 mm. All lines indicate a situation for which the volume is filled at an angle $\alpha_1$=90° to such a starting height that when $\alpha_2$=0 the volume is totally filled (h=100%). The thicker the plate the more the volume has to be filled at $\alpha_1$=90° or in other words the higher the 'starting height' is. The starting height for a thickness of 1.3 mm is in this example 38.1%, at a thickness of 2.0 mm 46,4% and at a thickness of 3.2 mm 63.2%. It is much more accurate to fill the volume to a selected height then with a selected amount of resin. The actual outer contour of the display window as well as the actual height of the seal greatly influence the nominal volume. The nominal volume may differ by tens of percents. If a 'standard' amount of resin would be used such standard amount must always be sufficient to fill even in a worst case scenario. Thus on average much more than needed must be used. This on average unneeded extra amount has to be removed most of the time, which is messy at best, and which requires using much more resin than actually necessary. By filling up to a selected level this margin of error is greatly reduced. FIG. 5 shows exemplary data, which are not to be taken to restrict the invention. Line 64 in FIG. 5 indicates the relation between height h and angle of tilt $\alpha$ in a method in accordance with the invention. For instance for an auxiliary plate with a thickness of 1.3 mm, the starting level ($\alpha$=90°) is above 38.1% for instance approximately 10% above said height (h≈41%). The starting angle of tilt is preferably 90° because at such an angle, i.e. when the display window is oriented substantially vertically the uncured resin flows most easily in the volume in between the display window and the auxiliary plate and air bubbles rise most easily. Preferably the angle is substantially 90°, but slightly less than 90°. When the angle of tilt $\alpha$ is reduced the volume is totally filled at an angle $\alpha_2$ larger than zero. If the angle of tilt would be reduced even further resin would flow out of the volume formed between the display window and auxiliary plate. Thus in effect there is more uncured resin in the volume than is needed to fill the nominal volume. At the tilt angle $\alpha_2$ the opening is plugged, preferably by using UV light to locally cure the resin. Thereafter the angle of tilt $\alpha$ is further reduced, preferably to substantially zero. The volume being slightly overfilled there will be s slight bulge in the auxiliary plate. However during curing the volume of the resin shrinks, reducing the bulge such that the plate follows to a great extent the contour of the display window.

It will be clear that within the concept of the invention many variations are possible.

The angle $\alpha_2$ (angle at which the opening is plugged) is chosen such that the overfill factor (i.e. ratio between volume of uncured resin and nominal volume between display window and auxiliary plate) corresponds grosso modo to the shrinkage factor (i.e. volume ratio between uncured and cured resin) of the resin during curing. If the resin shrinkage factor is zero or nearly zero the angle $\alpha_2$ may be close to zero. In such circumstances the last step of the process may be omitted. The starting filing height at $\alpha_1$ is set at a selected value h. For most purposes setting a starting level at a selected value will suffice to perform the method. In a more sophisticated method, which could be advantageously employed, especially for very thin auxiliary plates, the level at the starting angle $\alpha_1$ is set, and at at least one angle intermediate between $\alpha_1$ and $\alpha_2$, preferably closer to $\alpha_2$ than to $\alpha_1$, the filling height h is measured. This will enable the curve 64 to be followed, to estimate more accurately the angle $\alpha_2$, and thereby to estimate more accurately the overfill factor, compare this with 'ideal values' and if needed, add resin to the volume or extract resin from the volume. Alternatively the tilt angle $\alpha_2$ may be measured and/or monitored. The tilt angle $\alpha_2$ in itself then provides information, i.e. a second point on the curve, which information may be used to readjust angle $\alpha_1$ and/or the starting height.

In general, a display device is manufactured having a display with an auxiliary plate. The display window 3 and the auxiliary plate 15 are oriented at an angle of tilt $\alpha_1$, preferably substantially vertically, the volume in between the display window and auxiliary plate is filed up to a selected level height h with uncured resin, a seal 17 and an opening 18 being provided at or near the highest point. Thereafter the display window is reoriented to a more horizontal position (smaller angle of tilt $\alpha_2$) the auxiliary plate being positioned on top of the display window inducing a flow v of curable material 16 towards the opening 18, and when the resin has reached the opening the resin near the opening is plugged, where after the angle of tilt is further reduced and the resin is fully cured.

What is claimed is:

1. Method of manufacturing a display device (1) having a display window (3) and in front of the display window an auxiliary transparent plate (15), in which method the display window (3) and the transparent plate (15) are positioned at some distance from each other, the display window and the auxiliary are attached to each other around the edges by a seal (17), the seal having at least one opening (18), the volume between the display window and the auxiliary plate being filled with curable material (16) where after the curable material is cured, characterized in that the display window (3) and the auxiliary plate (15) are oriented at an first angle of tilt ($\alpha_1$) to the horizontal direction, preferably substantially vertically, the volume is partially filed with uncured resin up to a selected level height h, the opening (18) being at or near the highest point, thereafter the angle of tilt is reduced to a second angle $\alpha_2$ smaller than the first angle $\alpha_1$, and when the resin has reached the opening the resin near the opening is cured to plug the opening, where after the angle of tilt is reduced to a third angle $\alpha_3$, preferably substantially zero, and the rest of the resin is fully cured.

2. Method as claimed in claim 1, characterized in that the opening is plugged by locally curing the curable material.

3. Method as claimed in claim 2 characterized in that the curable material near the filling is cured using UV light.

4. Method as claimed in claim 1, characterized in that during curing of the resin near the opening a gas flow of non-reactive gas is provided.

* * * * *